United States Patent [19]

Randolph

[11] Patent Number: 4,544,072

[45] Date of Patent: Oct. 1, 1985

[54] UNCOUPLING DEVICE WHICH COMPLIES WITH AAR SPECIFICATION

[75] Inventor: Robert W. Randolph, St. Charles, Mo.

[73] Assignee: ACF Industries, Incorporated, Earth City, Mo.

[21] Appl. No.: 110,431

[22] Filed: Jan. 7, 1980

[51] Int. Cl.[4] ..... B61G 3/08

[52] U.S. Cl. ..... 213/166; 213/219

[58] Field of Search ..... 213/165–170, 213/211, 213, 219; 308/4 R, 237 A, 3 R

[56] References Cited

U.S. PATENT DOCUMENTS

| | | | |
|---|---|---|---|
| 1,230,203 | 6/1917 | Murray | 213/169 |
| 2,184,818 | 12/1939 | Sisson | 213/167 |
| 2,942,582 | 6/1960 | Dempster et al. | 308/4 R X |
| 3,039,834 | 6/1962 | Howe | 308/4 R |
| 3,479,099 | 11/1969 | Krause | 308/4 R X |
| 3,598,250 | 8/1971 | Terlecky et al. | 213/166 X |
| 3,690,742 | 9/1972 | Sung | 308/3 R |
| 3,834,554 | 9/1974 | Chierici | 213/166 |
| 3,933,252 | 1/1976 | Murphy et al. | 213/166 |
| 4,010,854 | 3/1977 | Manyek | 213/166 |
| 4,025,129 | 5/1977 | Markfelder et al. | 308/3 R |

*Primary Examiner*—Randolph A. Reese

*Attorney, Agent, or Firm*—Polster, Polster and Lucchesi

[57] ABSTRACT

An uncoupling device (10) is provided with a handle (12) which is pivotably mounted on a bracket at the side of the car. The handle is connected to a bar (16) extending transversely of the car, at a level below a coupler extending out of a center sill. An uncoupling member (42) is slidingly attached to the bar with a connection allowing the uncoupler to slide longitudinally with respect to the bar when the coupler moves, and at the same time has sufficient interface with the bar to transmit torsion to the coupler (34) at a given position on the bar during rotation for uncoupling. The bar includes a stop (68) at its outer end to prevent the coupler member from escaping. The uncoupler member at its outer end includes an upwardly extending portion (70) having a hook (74) which is inserted into the opening (76) in a conventional E type coupler connection to operate the lock lifter mechanism (78) and disconnect coupled couplers. In order to avoid interference between the coupler connection and the hook when the coupler shank is rotated significantly off the center line of the car, the hook portion has a reduced thickness (90) on its outer external surface.

11 Claims, 5 Drawing Figures

UNCOUPLING DEVICE WHICH COMPLIES WITH AAR SPECIFICATION

BACKGROUND OF THE INVENTION

The current Association of American Railroads (AAR) specification provides that special uncoupling devices for cars with sliding sill cushioned underframes, or cars with end-of-car cushioning, or cars with standard draft gears with increased angularity be able to unlock in all positions of the coupler with an uncoupling force of not more than forty (40) pounds.

A typical uncoupling device includes a pivoting handle on the side of the car and extends from the side of the car to the coupler lock lifter. A hook on the uncoupling device engages an opening in the lock lifter. When the handle is rotated the lock lifter is rotated about a horizontal axis to move the lock lifter connector vertically to unlock the coupler.

The coupler and shank can pivot horizontally up to 18 degrees on either side of the car center line and has a longitudial travel of up to ±20 inches. This varies the angle the uncoupling device makes with the lock lifter assembly from about 90 degrees at the center line of the car with cushion unit extended to about 120 degrees when the coupler shank is pivoted toward the side where the handle is located and the cushion unit is compressed, to about 75 degrees when the coupler shank is pivoted off the center line away from the uncoupling handle and the cushion unit is extended

SUMMARY OF THE INVENTION

The object of the present invention is to provide an uncoupling arrangement which will comply with the AAR specification requiring that the arrangement be able to unlock couplers in all positions with a force not exceeding forty (40) pounds.

In accordance with the present invention an uncoupling device is provided with a handle which is pivotably mounted on a bracket at the side of the car. The handle is connected to a bar extending transversely of the car, at a level below a coupler extending out of a railway car center sill. An uncoupling member is slidingly attached to the bar through a rectangular connection allowing the uncoupler to slide longitudinally with respect to the bar when the coupler moves, and at the same time providing means of transferring torque between the members. The bar includes a stop at its outer end to prevent the coupler member from escaping. The uncoupler member at its outer end includes an upwardly extending portion having a hook which is inserted into the opening in a conventional E type coupler connection to operate the lock lifter mechanism and disconnect coupled couplers. In order to avoid interference between the coupler connector when the coupler shank is rotated significantly off the center line of the car, the hook portion is reduced in thickness on its outer external surface.

Preferably the connection between the bar and the uncoupling member includes a strap which surrounds the bar and is attached to the uncoupling member. Bearings are provided to allow free compression and extension of the uncoupling member in relation to the bar. The bearings are made of a low friction material and are generally C-shaped and include a thickened portion which engages retainers suitably welded to the strap and bar. The handle is conveniently formed as a piece of bent rod including a vertical portion welded to the inner end of the bar, a hook portion fitting through a bracket mounted on the car, and a handle portion extending downwardly and outwardly from the hook portion which is readily grasped by the operator to unlock the coupler.

A BRIEF DESCRIPTION OF THE DRAWINGS

DESCRIPTION OF PREFERRED EMBODIMENTS

Figures 1, 2, 3, 4, 5:
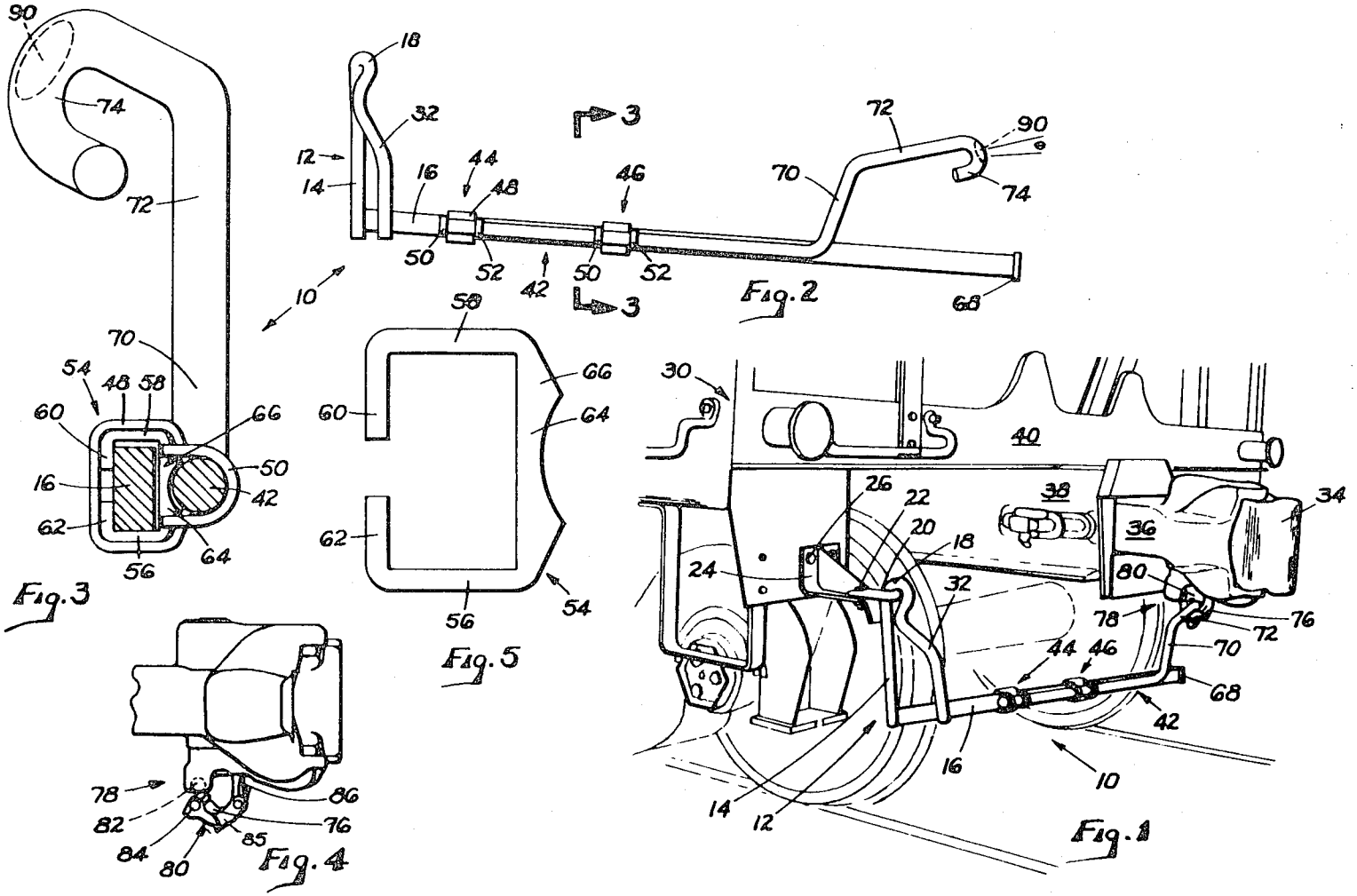
FIG. 1 is a perspective view of the uncoupling arrangement of the present invention.
FIG. 2 is a side elevation view of the uncoupling arrangement of the present invention.
FIG. 3 is a sectional view looking in the direction of the arrows along the line 3—3 in FIG. 2.
FIG. 4 is a detail view of the coupler including the uncoupling assembly utilized in the present invention.
FIG. 5 is a detail view of the bearing pad used in the present invention.

The uncoupling device of the present invention is indicated in the drawings generally at 10. This uncoupling device includes a handle portion 12 having a vertical portion 14 welded to a bar portion 16 and including an eye 18 extending through an eye 20 held in place with fasteners 22 upon a bracket 24. Bracket 24 is attached with fasteners 26 to the end structure of a railway car 30. The handle portion 12 further includes a handle 32 extending downwardly and outwardly from the eye portion 18.

Bar portion 16 extends transversely of the car and is located below an E type coupler 34 having a shank 36 extending out of a sill 38 located below the end sill 40.

An uncoupling member 42 is slidably connected to the bar portion 16 with connector assemblies 44 and 46. Each of the connector assemblies is constructed in the same manner and includes a strap 48 extending around and spaced from bar 16. Located between strap 48 and uncoupling member 42 is a bearing pad 54. As shown in FIG. 5, bearing pad 54 includes a pair of arms 56 and 58 having tabs 60 and 62 which surround and engage the bar 16. Bearing pad 54 further includes a base portion 64 including a thickened contour 66 adapted to engage bearing pad retainers 50 and 52. Bearing pads are of low-friction material such as ultra high molecular weight polyethylene. Retainers 50 and 52 are welded to the uncoupling member 42 and to the strap 48.

This arrangement provides clearance whereby the uncoupling member may slide relative to the bar portion 16 when the coupler 34 and the shank 36 move longitudinally relative to center sill 38 and/or pivot about a vertical axis and deviate from the center line of the car. This deviation may be as much as 18 degrees on either side. A stop 68 is located at the end of bar 10 to prevent loss of the uncoupling member 42.

Uncoupler 42 includes a first generally inclined vertical portion 70 which is relatively steep and a second vertical portion 72 which is less steep. A hook 74 is provided which is inserted into an opening 76 in the lock lift assembly 78 (FIG. 4). Specifically, opening 76 is located in a lock lift connector 80. Connector 80 is pivotably mounted about a horizontal axis by means of pins 82 and 84. Lock lifter bottom portion 85 containing the opening 76 is connected to an unlocking arm 86 extending upwardly to disconnect the E type coupler in the usual manner. See *Car and Locomotive Cyclopedia* 1970 Edition, pp. 523–530. Copy in application file.

The AAR regulations concerning uncoupling devices require that the uncoupling device be able to unlock coupler 34 at any position of the coupler 34 and shank 36. While no difficulty was experienced with couplers positioned along the center line of the car, difficulty was initially experienced when an effort was made to uncouple when the shank 36 was pivoted to either side of the center line of the car. The angle of portion 72 was varied and the contour of hook 74 was also varied. However, nonetheless, binding occurred and difficulty was experienced in causing the lock lifter assembly to uncouple the coupler when the shank 36 was in extreme positions relative to the center line of the car. However, it was found that by relieving a portion of the external surface of the hook 74 as indicated at 90, the difficulty in getting an uncoupling assembly to operate when the shank was located on either side of the center line of the car and, with the ccupler in its various longitudinal positions, was avoided. As shown in FIG. 3, it is convenient to grind or otherwise provide a flat on the external surface of the hook portion 74 in the area where it abuts the lock lifter to avoid binding. For a one (1) inch diameter rod, approximately one-fourth ($\frac{1}{4}$) inch should be removed. The center of the removed portion is located at an angle $\theta$ of ten (10) degrees with respect to a plane parallel to portion 72 and passing through the center of hook portion 74. For fifteen (15) inch travel couplers, the flat location is at 30° from the vertical center line of the hook. Installations with other than fifteen (15) inch travel will require this angle to be less than or greater than 30° to provide proper clearance.

The removed portion 90 can also be formed in uncoupling member 42 by forging.

In operation, the operator simply grasps handle 32 at the side of the car which rotates vertical portion 14, bar 16 and uncoupling member 42 upwardly. This rotational force pivots lock lifter connector 80 about horizontal pins 82 and 84 and moves unlocking arm 86 upwardly to unlock coupler from an adjacent coupler.

What is claimed is:

1. An uncoupling device comprising: a handle pivotably mounted at the side of the car; said handle being connected to a bar extending transversely of the car, at a level below a coupler extending out of a railway car center sill; an uncoupling member slidingly attached to said bar with an uncoupling connection allowing the uncoupler to slide longitudinally with respect to the bar when said coupler moves relative to aaid center sill; and at the same time having sufficient interface with the bar that sufficient motion can be transmitted when said handle is rotated to unlock said coupler; said uncoupler member at its outer end including an upwardly extending portion having a hook inserted into an opening in a coupler lock lifter to disconnect coupled couplers; said hook portion being in continuous engagement with said lock lifter and having a portion of reduced thickness to avoid interference between the coupler lifter and said hook portion when the coupler shank is rotated significantly off the centerline of the car, or is moved longitudinally of the center sill.

2. An uncoupling device according to claim 1 including a pair of uncoupling connections between said bar and said uncoupling member.

3. An uncoupling device according to claim 1 wherein said portion of reduced thickness is formed by grinding.

4. An uncoupling device according to claim 1 wherein said portion of reduced thickness is formed by forging.

5. An uncoupling device according to claim 1 wherein said uncoupling connection includes a bearing pad located between said bar and said uncoupling member.

6. An uncoupling device according to claim 5 including a strap which surrounds said bar and said bearing pad.

7. An uncoupling device according to claim 6 wherein said bearing pad engages said strap, said rod and said uncoupling member.

8. An uncoupling device according to claim 7 wherein a pair of retainers are welded to the ends of said strap surrounding said uncoupling member.

9. An uncoupling device according to claim 8 wherein said bearing pads are generally U-shaped and include a curved portion which engages said uncoupling member.

10. An uncoupling device according to claim 1 wherein said handle is formed as a piece of bent rod including a vertical portion welded to the inner end of the bar, a hook portion fitting through a bracket mounted on the car, and a handle portion extending downwardly and outwardly from the hook portion.

11. An uncoupling device comprising:

a handle pivotably mounted at the side of the car; said handle being connected to a bar extending transversely of the car at a level below a coupler extending out of the railway car center sill; an uncoupling member slidingly attached to said bar with an uncoupling connection allowing the uncoupler to slide longitudinally with respect to the bar when said coupler moves relative to said center sill and at the same time having sufficient interface with the bar that sufficient motion can be transmitted when said handle is rotated to unlock said coupler; said uncoupler member at its outer end including an upwardly extending portion having a hook inserted into an opening in a coupler lock lifter to disconnect coupled couplers; said hook portion being in continuous engagement with said lock lifter and having a portion of reduced thickness on its outer external surface to avoid interference between the coupler lifter and said hook portion when the coupler shank is rotated significantly off the centerline of the car or is moved longitudinally relative to said center sill; said uncoupling connection including a bearing pad made of low friction material located between said bar and said uncoupling member; a strap surrounding said bar and said bearing pad, whereby said bearing pad engages said strap, said bar and said uncoupling member; a pair of retainers respectively located at either end of said strap; each of said retainers being connected to said uncoupling member and said strap, and including means for maintaining said bearing pad in place solely within said strap and between said retainers; said bearing pad being movable with said strap and uncoupling member relative to said bar.

* * * * *